US007774900B2

(12) United States Patent
Shaw

(10) Patent No.: US 7,774,900 B2
(45) Date of Patent: Aug. 17, 2010

(54) HINGE FOR A MOTOR VEHICLE

(75) Inventor: David W Shaw, Richmond Hill (CA)

(73) Assignee: Ventra Group, Inc., Ontario (CA)

( * ) Notice: Subject to any disclaimer, the term of this patent is extended or adjusted under 35 U.S.C. 154(b) by 1018 days.

(21) Appl. No.: 11/417,062

(22) Filed: May 4, 2006

(65) Prior Publication Data

US 2007/0256277 A1 Nov. 8, 2007

(51) Int. Cl.
*E05D 11/10* (2006.01)

(52) U.S. Cl. ..... 16/343; 16/371; 296/193.11; 180/69.2

(58) Field of Classification Search ..... 16/343, 16/346, 374, 375, 82, 85, 86 C, 363, 319, 16/321, 327, 371; 296/193.11, 76, 146.11, 296/146.12; 180/69.2, 69.21
See application file for complete search history.

(56) References Cited

U.S. PATENT DOCUMENTS 4,727,621 A * 3/1988 Emery et al. ..... 16/239
5,718,019 A * 2/1998 Cheal ..... 16/388
6,370,733 B2 4/2002 Paton et al.
6,442,801 B1 * 9/2002 Kim ..... 16/361
6,520,557 B2 2/2003 Benthaus et al.
6,607,236 B2 8/2003 Mooy et al.
6,681,448 B2 1/2004 Liang
6,901,630 B2 6/2005 Liang et al.
6,901,634 B2 6/2005 Shaw et al.
7,137,174 B2 * 11/2006 Derbis et al. ..... 16/289
2002/0000022 A1 * 1/2002 Schillaci et al. ..... 16/319
2008/0034552 A1 * 2/2008 Nguyen ..... 16/375

* cited by examiner

*Primary Examiner*—William L. Miller
(74) *Attorney, Agent, or Firm*—Pillsbury Winthrop Shaw Pittman LLP

(57) ABSTRACT

A hinge for use in a motor vehicle, including first and second members pivotably coupled to each other. First and second position retainers are coupled between the first member and the second member to releasably secure the second member in a first holding position relative to the first member. The first position retainer has a first holding portion and the second position retainer has a second holding portion such that one of the first and second position retainers is structured and arranged to move relative to the other of the first and second position retainers such that the first and second holding portions move into and out from a first holding position. The first and second holding portions are structured and arranged to be releasably secured to each other in the first holding position.

26 Claims, 11 Drawing Sheets

HINGE FOR A MOTOR VEHICLE

FIELD OF THE INVENTION

The present invention relates to a hinge. More specifically, the present application provides illustrated embodiments of the present invention, including those relating to a hinge for use, for example, in a motor vehicle.

BACKGROUND

One example of a prior art mechanism for maintaining a trunk lid in an open position includes a gas spring, as disclosed in U.S. Pat. No. 6,520,557 to Benthaus et al., which is incorporated herein in its entirety by reference thereto.

SUMMARY OF THE INVENTION

One aspect of the invention relates to a hinge for use in a motor vehicle, including a first member; a second member pivotably coupled to the first member so that the second member may pivot vertically with respect to the first member such that the second member may pivot upwardly in an opening direction, which is away from the first member and towards an open position, and downwardly in a closing direction, which is away from the open position and towards the first member; and first and second position retainers coupled between the first member and the second member to releasably secure the second member in a first holding position relative to the first member, the first position retainer having a first holding portion and the second position retainer having a second holding portion, one of the first and second position retainers being structured and arranged to move relative to the other of the first and second position retainers such that the first and second holding portions releasably engage one another in a first holding position of the second member, the first and second holding portions being structured and arranged to be releasably secured to each other in the first holding position.

Another aspect of the invention relates to a hinge for use in a motor vehicle, including a first member; a second member pivotably coupled to the first member so that the second member may pivot with respect to the first member; and first and second position retainers coupled between the first member and the second member to releasably secure the second member in a first holding position relative to the first member, the first position retainer having a first holding portion and the second position retainer having a second holding portion, one of the first and second position retainers being structured and arranged to move relative to the other of the first and second position retainers such that the first and second holding portions releasably engage one another in a first holding position of the second member, the first and second holding portions being structured and arranged to be releasably secured to each other in the first holding position, one of the first and second holding portions including a pivot part that pivots with respect to the first and second members and a resilient part that releasably engages the other of the first and second holding portions to releasably secure the first and second holding portions in the first holding position.

Another aspect of the invention relates to a hinge for use in a motor vehicle, including a first member; a second member pivotably coupled to the first member so that the second member may pivot with respect to the first member; a third member pivotably coupled to each of the first and second members; and first and second position retainers coupled between the first member and the second member to releasably secure the second member in a first holding position relative to the first member, one of the first and second position retainers being attached to the third member, the first position retainer having a first holding portion and the second position retainer having a second holding portion, one of the first and second position retainers being structured and arranged to move relative to the other of the first and second position retainers such that the first and second holding portions releasably engage one another in a first holding position of the second member, the first and second holding portions being structured and arranged to be releasably secured to each other in the first holding position.

Yet another aspect of the subject invention relates to a hinge assembly for a motor vehicle, including a first member coupled to a first part of a motor vehicle; a second member coupled to an access panel of a motor vehicle and pivotably coupled to the first member so that the access panel of the motor vehicle may pivot upwardly with respect to the first part of the motor vehicle into an open position; and first and second position retainers coupled between the first member and the second member to releasably secure the second part of the motor vehicle in a first holding position relative to the first part of the motor vehicle, the first position retainer having a first holding portion and the second position retainer having a second holding portion, one of the first and second position retainers being structured and arranged to move relative to the other of the first and second position retainers such that the first and second holding portions releasably engage one another in a first holding position of the second member, the first and second holding portions being structured and arranged to be releasably secured to each other in the first holding position.

Other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DESCRIPTION OF ILLUSTRATED EMBODIMENTS

Figure 1:
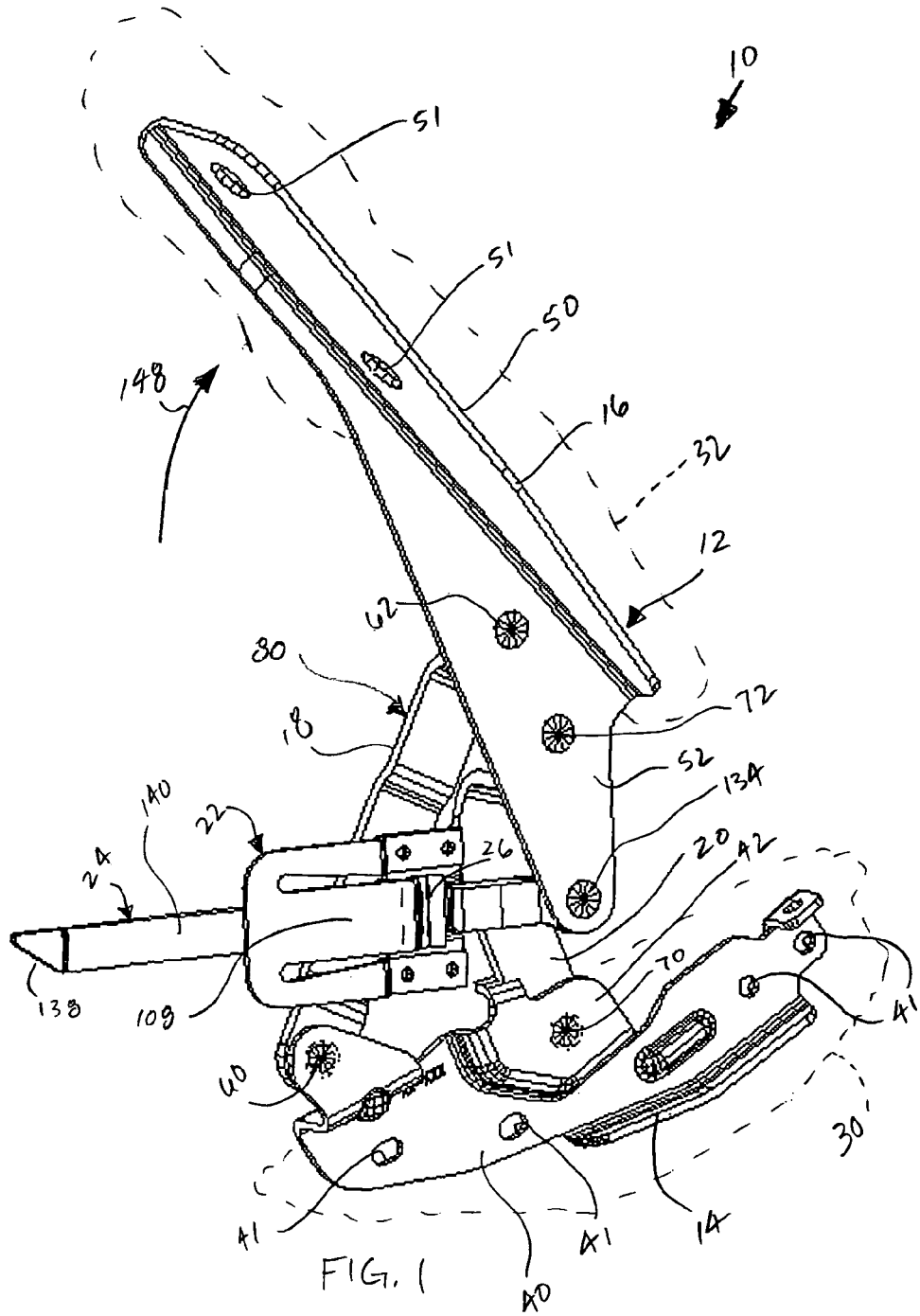
FIG. 1 illustrates a perspective view of a hinge in the open position, in accordance with one illustrated embodiment of the present invention.

FIGS. 1-9 illustrate one embodiment of the subject invention. FIG. 1 shows a hinge assembly 10, including a hinge 12 having a first member 14 and a second member 16 pivotably coupled to the first member 14 so that the second member 16 may pivot with respect to the first member 14. Coupled between the first and second members 14 and 16 are a third member 18 and a fourth member 20. Also coupled between the first and second members 14 and 16 are first and second position retainers 22 and 24, which releasably secure the second member 16 in a first pivot position relative to the first member 14 through the use of first and second holding portions 26 and 28. One embodiment of the hinge 12 includes its use in a pivoting connection between two parts 30 and 32 of a motor vehicle such that a second part 32 may pivot relative to a first part 30, for example, the second part 32 may include a hood or a trunk lid of a motor vehicle. Thus, the hinge assembly 10 may provide a hinge that is easier to install, uses fewer parts, and/or is less expensive than previous hinges used for motor vehicle hoods and trunk lids.

Although the hinge 12 can take various forms, in the illustrated embodiment of FIGS. 1-9, the hinge 12 is configured as a hinge for a motor vehicle, for example, a hinge for permitting the pivoting of a hood to access the inner, front part of the motor vehicle. FIG. 1 shows first member 14 as a first link having a connecting part 40 for connecting to a first part 30 of the motor vehicle body, such as a front frame member, and a lug 42 that connects to the other members or links 16, 18, and 20. Second member 16 is shown as a second link having a connecting part 50 for connecting to the hood 32 or other part of the vehicle that is pivoted, and a lug 52 that connects to the other members or links 18, 20 and 22. The connections between the links 14 and 16 and their respective parts 30 and 32 of the motor vehicle may be made by any appropriate fastening mechanisms such as by fasteners extending through openings 41 extending through connecting part 40 and through openings 51 extending through connecting part 50.

Third member 18 is shown as a third link that extends between the first and second links 14 and 16 and is pivoted at one end to first link 14 via pivot coupling 60 and pivoted at its other end to second link 16 via pivot coupling 62. Fourth member 20 is shown as a fourth link that extends between the first and second links 14 and 16 and is pivoted at one end to first link 14 via pivot coupling 70 and pivoted at its other end to link 16 via pivot coupling 72. The pivot couplings 60, 62, 70, and 72 may be any appropriate couplings that provide appropriate fastening while providing the necessary pivoting between the members 14, 16, 18, and 20, for example, the pivoting pins may be employed.

Thus, links 14, 16, 18, and 20 form a hinge linkage 80 that permits the second vehicle part 32 to pivot with respect to the first vehicle part 30. Although links 14, 16, 18, and 20 are each illustrated as a unitary element, each link may be formed as a combination of any number of elements. Also, links 14, 16, 18, and 20 may be formed of any appropriate material, including metal. Additionally, although the links 14, 16, 18, 20 illustrated in FIG. 1 are arranged as a four-bar linkage, it should be appreciated that various linkages may be employed to accomplish the function of permitting the first part 30 to pivot relative to the second part 32. Even though only one linkage 80 is shown as providing the pivoting mechanism between the first and second parts 30 and 32 of the vehicle, any number of linkages 80 may be employed to appropriately support and provide pivoting for the desired part 32 to be pivoted. For example, hoods or trunk lids are commonly pivoted at two points that are positioned on opposite ends of the respective hood or trunk lid. In such a case, two linkages 80 may be employed for a hood or trunk lid, at opposite ends of the hood or lid, with each of the two linkages 80 being substantially identical. Of course, the two opposing linkages 80 may be configured as mirror images of one another.

Coupled within the hinge 12 is a position retainer assembly 100 that permits the pivoting part 32 to maintain at least one open position so that the pivoting part 32 will remain spaced from the first part 30 at a predetermined pivot location. Position retainer assembly 100 also permits the pivoting part 32 to move out of an open position so that the pivoting part 32 may be moved to another open position or to the closed position. That is, the position retainer assembly 100 operates to maintain the hinge 10 in the open position shown, e.g., FIG. 2, and is releasable to allow the hinge to move to the closed position, e.g., shown in FIG. 3. In the case of a hood or a trunk lid, the position retainer assembly 100 permits the hood or lid to remain open so that an interior portion of the vehicle, such as an engine or a trunk, may be accessed without manually holding the hood or trunk in the open position. Although, as is described herein, the position retainer assembly 100 may be designed to maintain the pivoting part 32 in a single open position, the position retainer assembly 100 may be designed and configured, as also described herein, to maintain the pivoting part 32 in more than one open position. Thus, in the example of a hood covering an engine, the position retainer assembly 100 may have a first opening position to permit the hood to open to a maximum amount so that an engine part may be installed, but then also have a regular opening position that maintains the hood in a position that is closer to the closed position than the maximum open position, while still enabling routine access to the engine. Other open positions may be employed such as a lower, open position, which maintains the hood in a position that is closer to the closed position than the regular open position, while still enabling sufficient access to the engine.

The position retainer assembly 100 can take various forms. The position retainer assembly 100 illustrated in FIGS. 1-8 includes the first position retainer 22 in the form of a resilient link and the second position retainer 24 in the form of a check link. As seen in the figures, including in FIGS. 4*b* and 4*c*, the resilient link 22 is pivotably coupled to the third link 18 by a support member 102, which is pivotably coupled to the third link 18 by a pivot pin 104. The resilient link 22 is illustrated as a spring having two, spaced projecting legs 106 and a projecting, central arm 108 with a holding portion in the form of a catch 26. The legs 106 and arm 108 extend from the connecting section 112. The resilient link 22, in the illustrated embodiment, may be configured so that the catch 26, or other engaging portion, may resiliently move into and out from the holding portion 28 as described herein. The resilient link 22 may be formed of a variety materials, including metal and plastic.

As illustrated, the resilient link 22 may be formed as a leaf spring attached to the support 102 at each of the two legs 106.

Figure 4A:
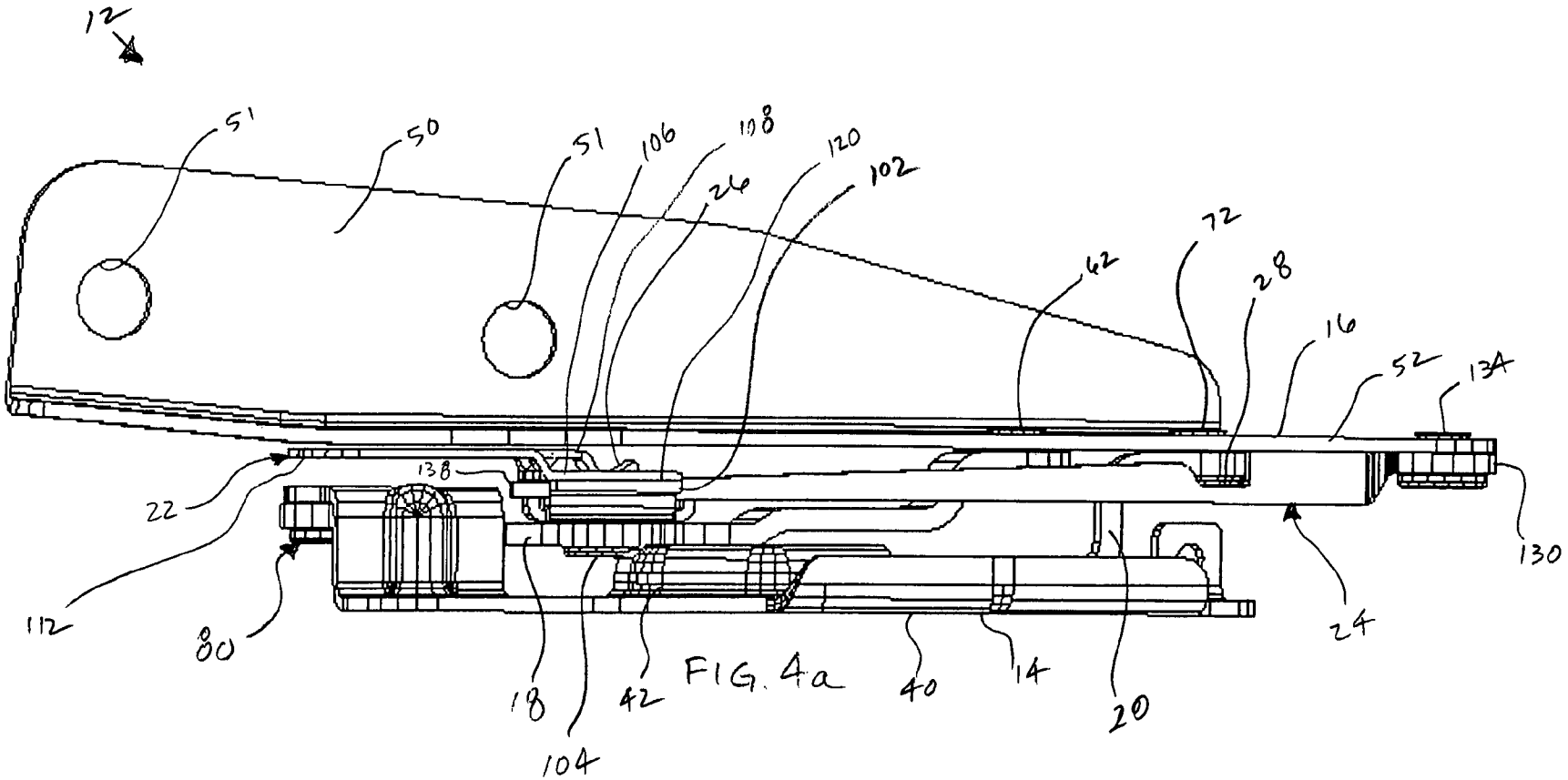
FIG. 4*a* is a bottom view of the hinge of FIG. 1 in the closed position.
Figure 4B:
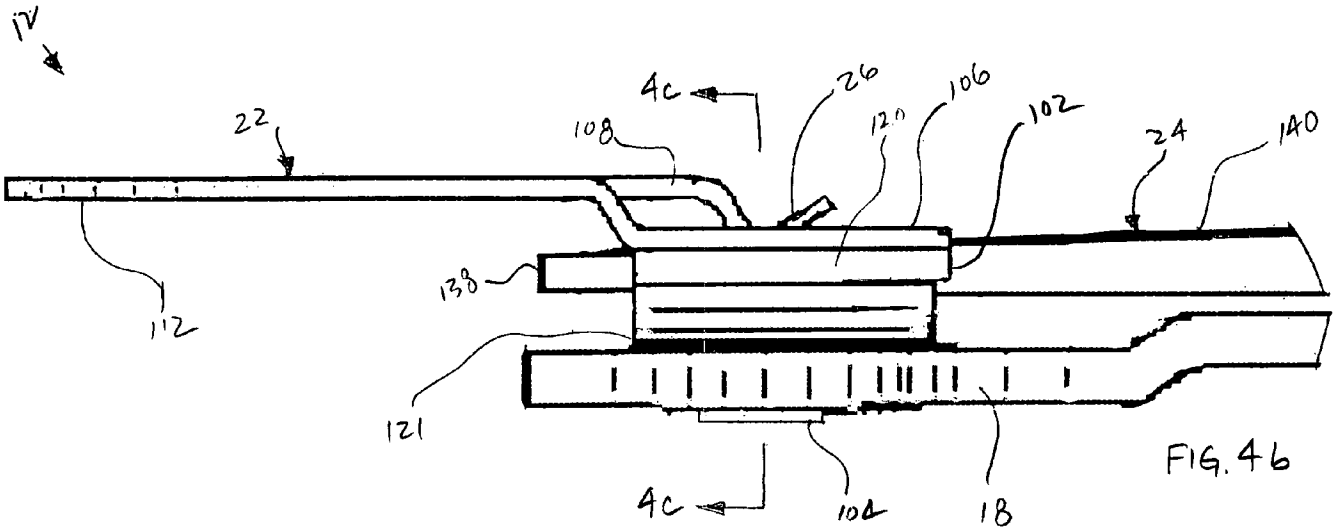
FIG. 4*b* is an exploded, partial side view of the connection of the resilient link to the linkage and to the check link in the closed position.
Figure 4C:
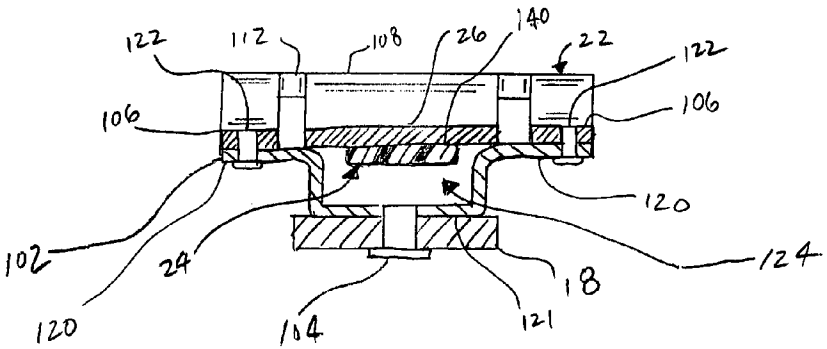
FIG. 4*c* illustrates a cross-sectional view taken through line 4*c*-4*c* in FIG. 4*b*.

Support 102 may be a spring pivot bracket and be generally U-shaped in cross-section with two flanges 120 that extend from a base 121. Each of the flanges 120 correspond to a respective leg 106 of the support 102 so that the flanges 120 and the legs 106 may be connected together. The flanges 120 and legs 106 may be connected in a variety of ways, including by fasteners 122, so that the link 22 and the support 102 are rigidly connected together and move as one member. When the resilient link 22 and the support 102 are joined, the separation between the base 121 and the arm form a passageway 124, through which the check link 24 may pass as described herein and as seen in FIG. 4*c*.

Although the resilient link 22 and the support 102 are illustrated as two separate members that are fastened together, they could also be made of additional members, or as a unitary member. The support 102 is pivotably coupled to the third link 18 in any appropriate manner, such as by a pivot pin 104, as illustrated, so that the resilient link 22 and the support 102 may pivot about the pin 104 and pivot relative to the third link 18.

The second position retainer, illustrated as check link 24, is formed to move relative to the resilient link 22 and provide one or more holding portions 28 that releasably engage with the resilient link 22. As seen in the figures, including in FIGS. 7-9, check link 24 may be an elongated member with a pivot end 130 that is pivotably coupled to second link 16 and a sloped portion 136. In the illustrated embodiment, the pivot end 130 has an opening 132 and is coupled to the second link 16 by a pivot pin 134 that extends through the opening 132 and through a corresponding opening in the second link 16. The sloped portion 136 extends from the pivot end 130 to the free end 138 while exhibiting a gradually, sloped or inclined surface 140 such that the check link 16 gradually becomes thinner as the sloped surface 140 extends to the free end 138. A holding portion 28 in the form of a recess is positioned toward the thicker end and adjacent the pivot end 130. Recess 28 has a sloped edge 142 on the side toward the free end 138 and a sharp, stop edge 144 on the side toward the pivot end 130. The stop edge 144 is shown as being approximately 90 degrees, and may also be past 90 degrees, the point being to stop further movement of the check link 24. The sloped edge 142 is shown as approximately 45 degrees, and may be at other angles lower than 90 degrees suitable to allow the engaging portion 26 of check link 24 to be cammed out of the recess 28 (see position "B" in FIG. 8). Together, the catch 26 and the recess 28 form a detent that permits the catch 26 to be releasably secured within the recess 28. The sloped edge 142 is designed to permit the catch 26 to be sufficiently held within the recess 28 while being able to be removed upon the application of an appropriate, reasonable force. The check link 24 may be formed of various materials, including plastic and metal. The check link 24 may take various forms, but is illustrated as a single member formed of unitary construction.

Figure 7:
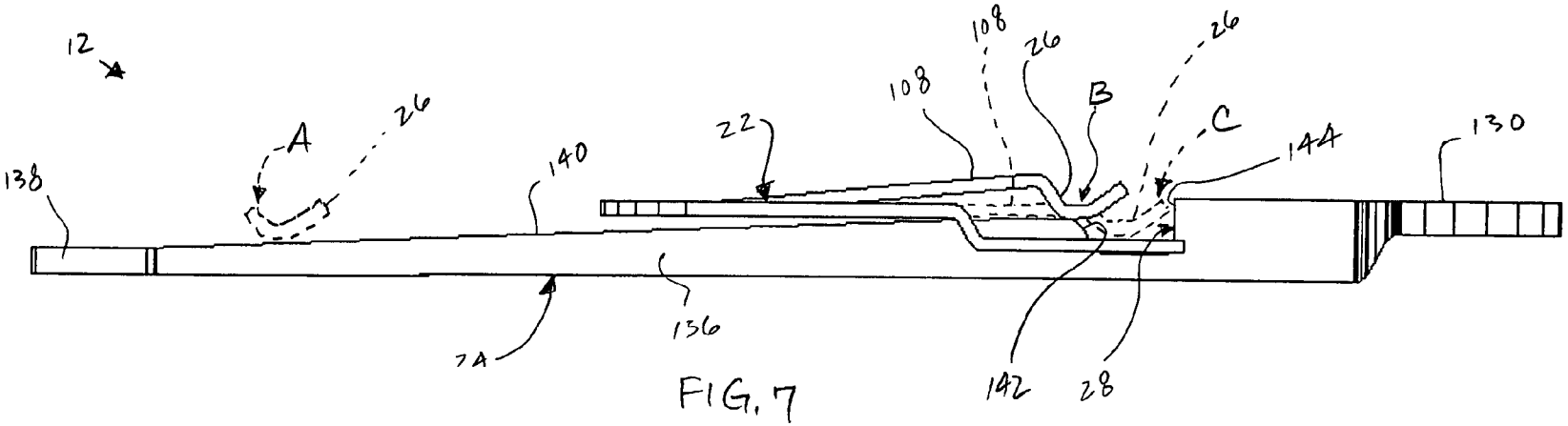
FIG. 7 illustrates an isolated, bottom view of the check link and a partial bottom view of the resilient link, with the closed and fully-engaged positions of the resilient link shown in dashed lines.
Figure 8:
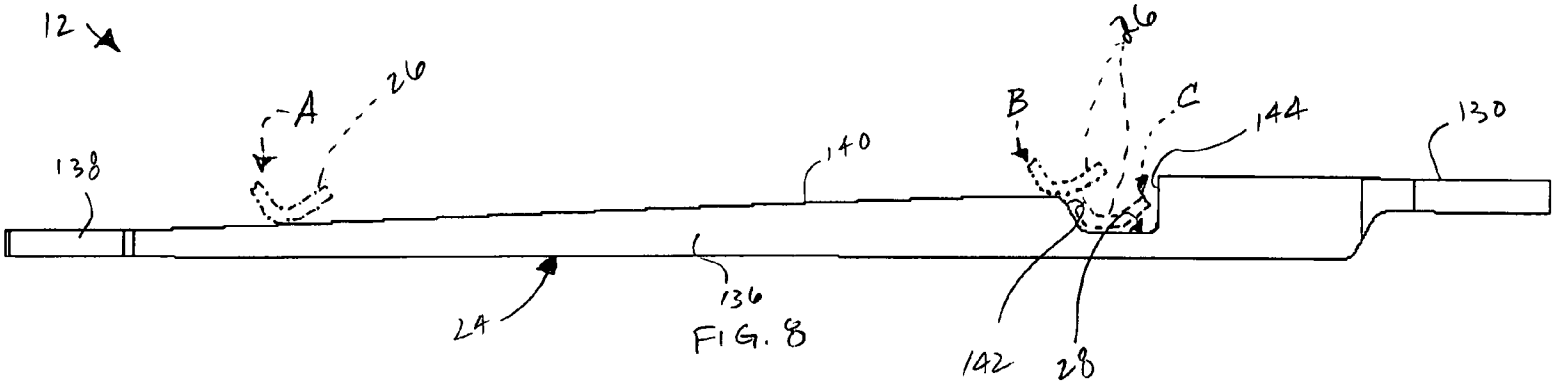
FIG. 8 illustrates an isolated, bottom view of the check link with the closed, engaged, and intermediate positions of the resilient link shown in dashed lines.
Figure 9:
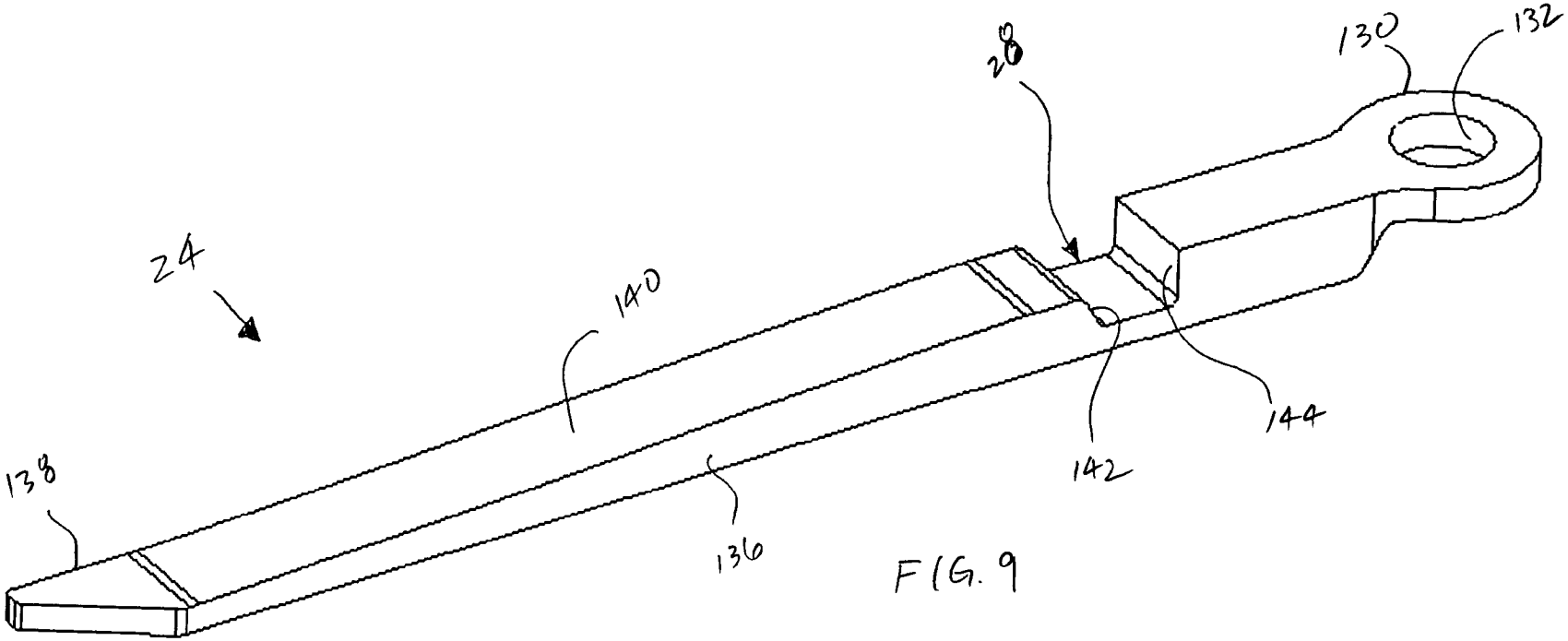
FIG. 9 illustrates a perspective view of one embodiment of a check link in accordance with the subject invention.

The hinge assembly 12 will now be described with respect to its use with in connection with a motor vehicle hood or trunk lid. In use, the hinge assembly 10 may start in the closed position as illustrated in FIGS. 3, 4*a*, 4*b*, and 4*c*. In the closed position, the second part 32 is adjacent the first part 30 and the free end 138 of the check link 24 is positioned within the passageway 124 between the support 102 and the resilient link 22. The arm 108 is in a neutral position. In the case of a hood or trunk lid, the hood or lid would be in the closed position. In FIGS. 7 and 8, the position of the catch 26 relative to the check link 24 and the recess 28 is shown as position "A."

In the instance of the hinge assembly 10 used with a hood or lid, if it was desired to access the area beneath the hood or lid 32, the hood or lid would be raised in the opening direction 148 and the links 16, 18 and 20 of linkage 80 would begin movement relative to each other and to link 14. Also, the check link 24 would begin moving through the passageway 124 as the recess 28 moves closer to the catch 26. With respect to FIGS. 7 and 8, the catch 26 begins moving from position "A" toward position "B."

As the hood or lid 32 continues to be opened in the opening direction 148, the links 16, 18, and 20 of linkage 80 continue to pivot relative to each other, and the resilient link 22 and the check link 24 continue to move relative to each other as the catch 26 continues to move along the sloped surface 140 toward the recess 28. While the catch 26 progresses up the sloped surface 140, the arm 108 of the resilient link 22 is gradually deflected from its position when the hinge 12 is in the closed position. Thus, the arm 108 will gradually increase its force against the check link 24 as the catch 24 progresses up the sloped surface. Thus, the force necessary to open the hood or lid will gradually increase. The additional force necessary to move the catch 26 up the slope may be minimal and not significantly felt by the user while opening the hood or lid 32. However, the additional force may be designed to be discernable by the user opening the hood or lid 32 so that the user is aware that the first holding position is approaching.

Figure 5:
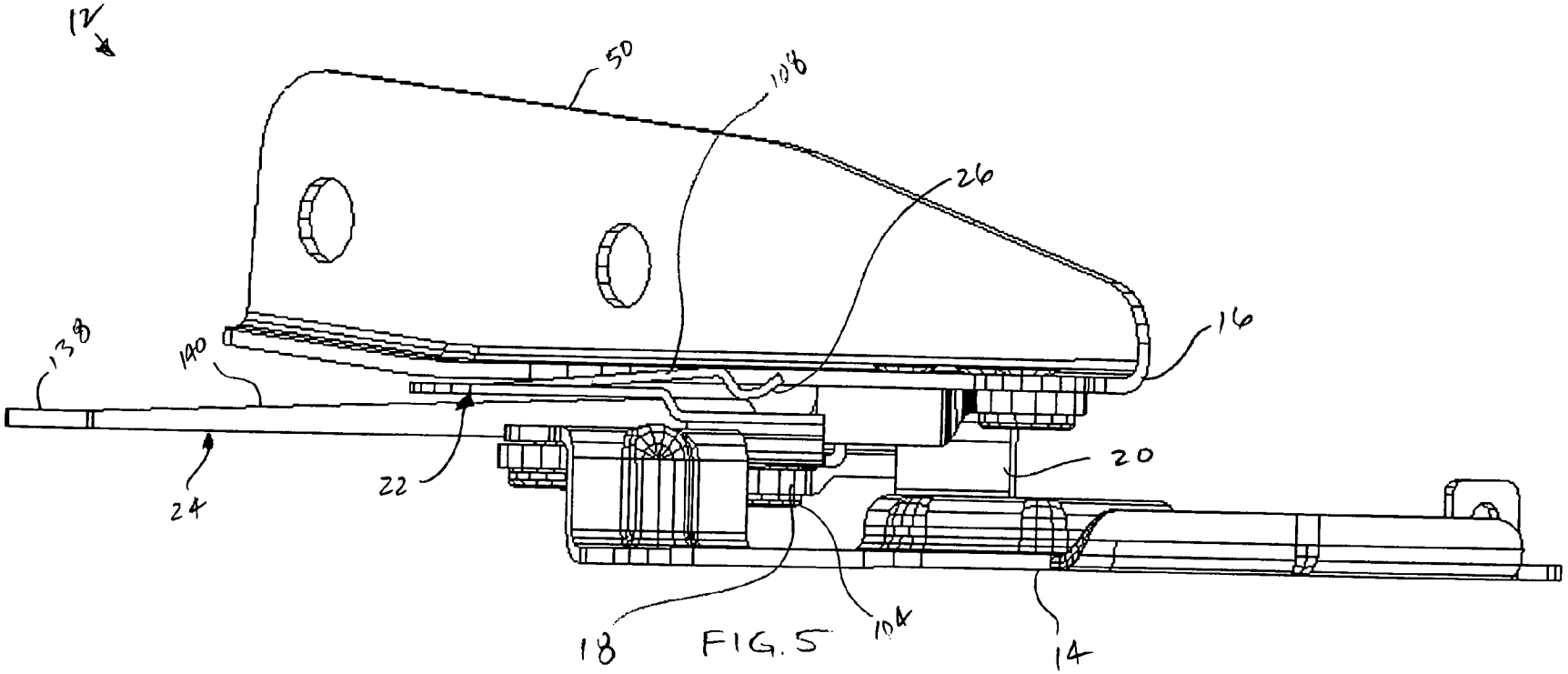
FIG. 5 is a bottom view of the hinge of FIG. 1 in a partially open position.
Figure 6:
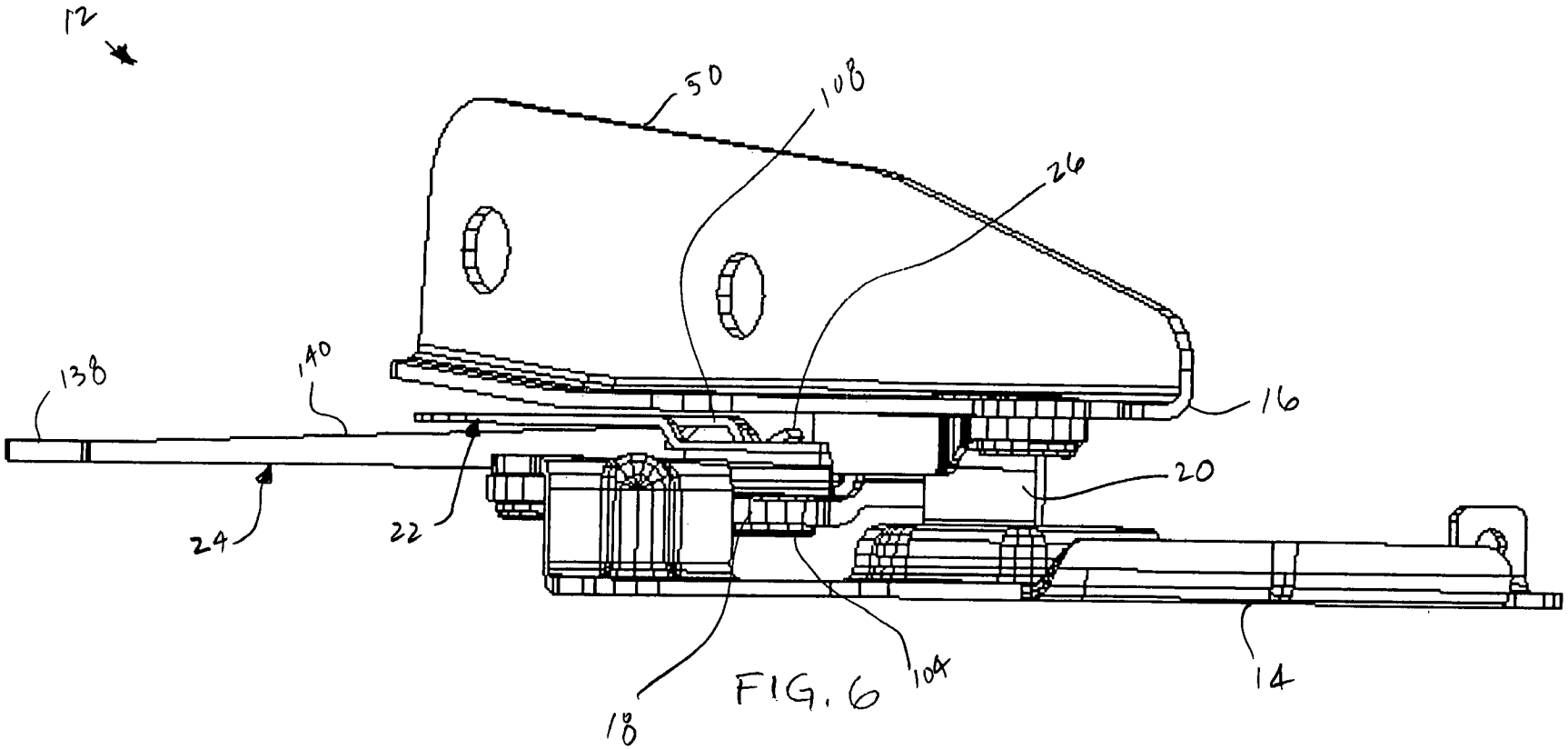
FIG. 6 is a bottom view of the hinge of FIG. 1 in an open position.

As seen in FIGS. 5, 7, and 8, when the hood or lid 32 is moved sufficiently such that the catch 26 is adjacent the recess 28, the arm 108 is at its maximum point of deflection and is applying its maximum force against the check link 24. With respect to FIGS. 7 and 8, the position of catch 26 relative to check link 24 and recess 28 is shown as position "B."

Figure 2:
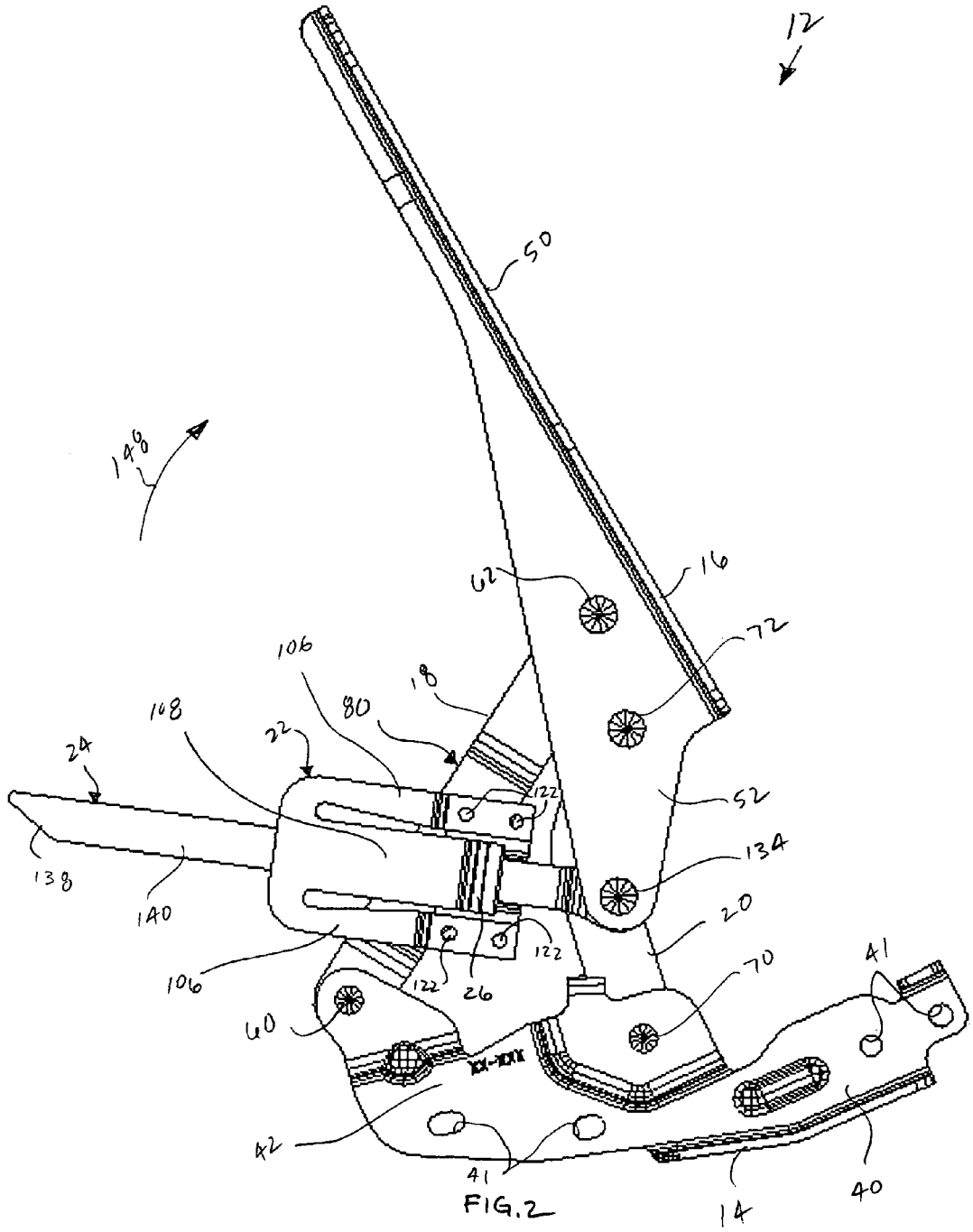
FIG. 2 illustrates a side elevational view of the hinge of FIG. 1.
Figure 3:
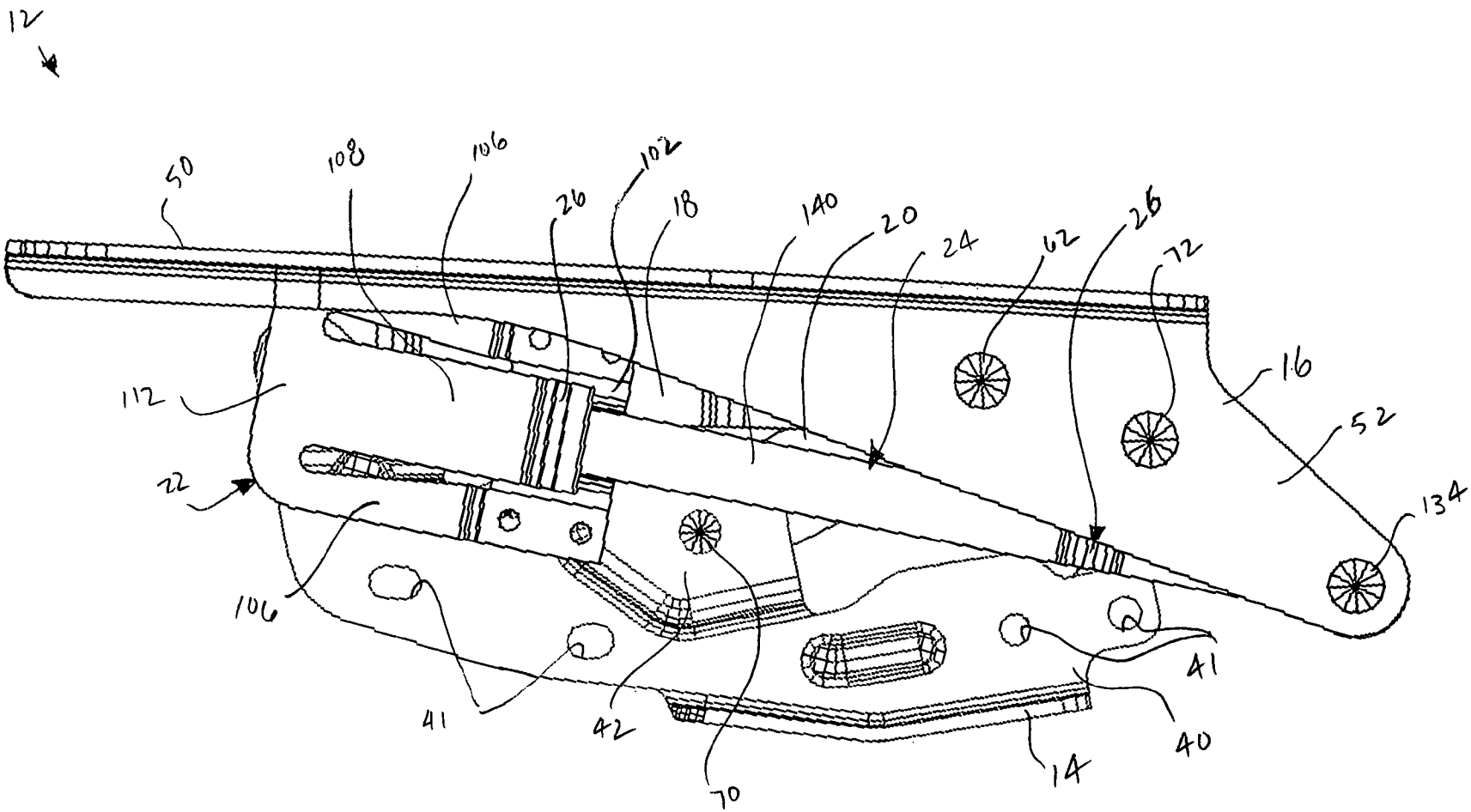
FIG. 3 illustrates a side elevational view of the hinge of FIG. 1 in the closed position.

Upon further upward movement of the hood or lid 32 in the opening direction 148, the links 16, 18, and 20 of linkage 80 continue to pivot relative to each other, and the resilient link 22 and the check link 24 continue to move relative to each other until the catch 26 has been moved beyond the sloped surface 140 and into the recess 28 by the spring force of the arm 108. The links 16, 18, and 20 then stop moving relative to each other and the linkage 80 and the hood or lid 32 is securely in the first holding position and is maintained within the recess 26 by the spring force of the arm 108. If an attempt is made to further open the hood or lid 32, the catch 26 will abut the stop edge 144, which may be configured to prohibit further movement of the catch 26 toward the pivot end 130 of the check link 24. This effectively prohibits the hood or lid 32 from pivoting further in the opening direction 148 (as indicated in FIGS. 1 and 2). The sloped edge 142 is sufficiently sloped and configured so that the hood or lid 32 is securely held in the first holding position by the spring force of the arm 108 so that the area beneath the hood or lid 32 may be accessed as desired without the fear of the hood or lid unintentionally moving out of the first holding position. The appropriate force to maintain the hinge assembly 10 in the first holding position may be established by the stiffness and strength of the arm 108 of the resilient link 22 and the ability of the arm 108 to apply a sufficient force against the check link 24 to maintain the catch 26 within the recess 28 and keep the catch 26 from moving up the sloped edge 142 of the recess. Of course, the configuration of the sloped edge 142 of the recess 28 will contribute to the force necessary to move the catch 26 out from within the recess 28. With respect to FIGS. 7 and 8, the position of catch 26 relative to check link 24 and recess 28 is shown as position "C."

When it is desired to close the hood or lid 32, an appropriate force is applied to the hood or lid 32 in the closing direction, opposite to the opening direction 148 and toward the first part 30. The appropriate force must be sufficient to overcome the resilient force of the arm 108 that maintains the resilient link 22 in the recess 28 so that the arm 108 will deflect and the catch 26 will move up the sloped edge 142 and out of recess 28 to disengage the detent. Upon the application of the appropriate closing force in the closing direction, the hinge assembly 10 will move out from the first holding position and reverse the course taken in originally reaching the first holding position. Thus, the hinge assembly 10 is moved such that the catch 26 will move onto the sloped surface 140 adjacent the recess 28 to the position shown in FIG. 5 and illustrated in FIGS. 7 and 8 as position "B."

Upon further closing of the hood or lid 32, the links 16, 18, 20 of the linkage 80 will continue pivoting relative to each other until the hinge assembly returns to the closed position, which is illustrated in FIGS. 3, 4*a*, 4*b*, and 4*c*, and which is shown in FIGS. 7 and 8 as position "A." The opening and closing of the hood or lid 32 may be repeated as many times as necessary.

Figure 10:
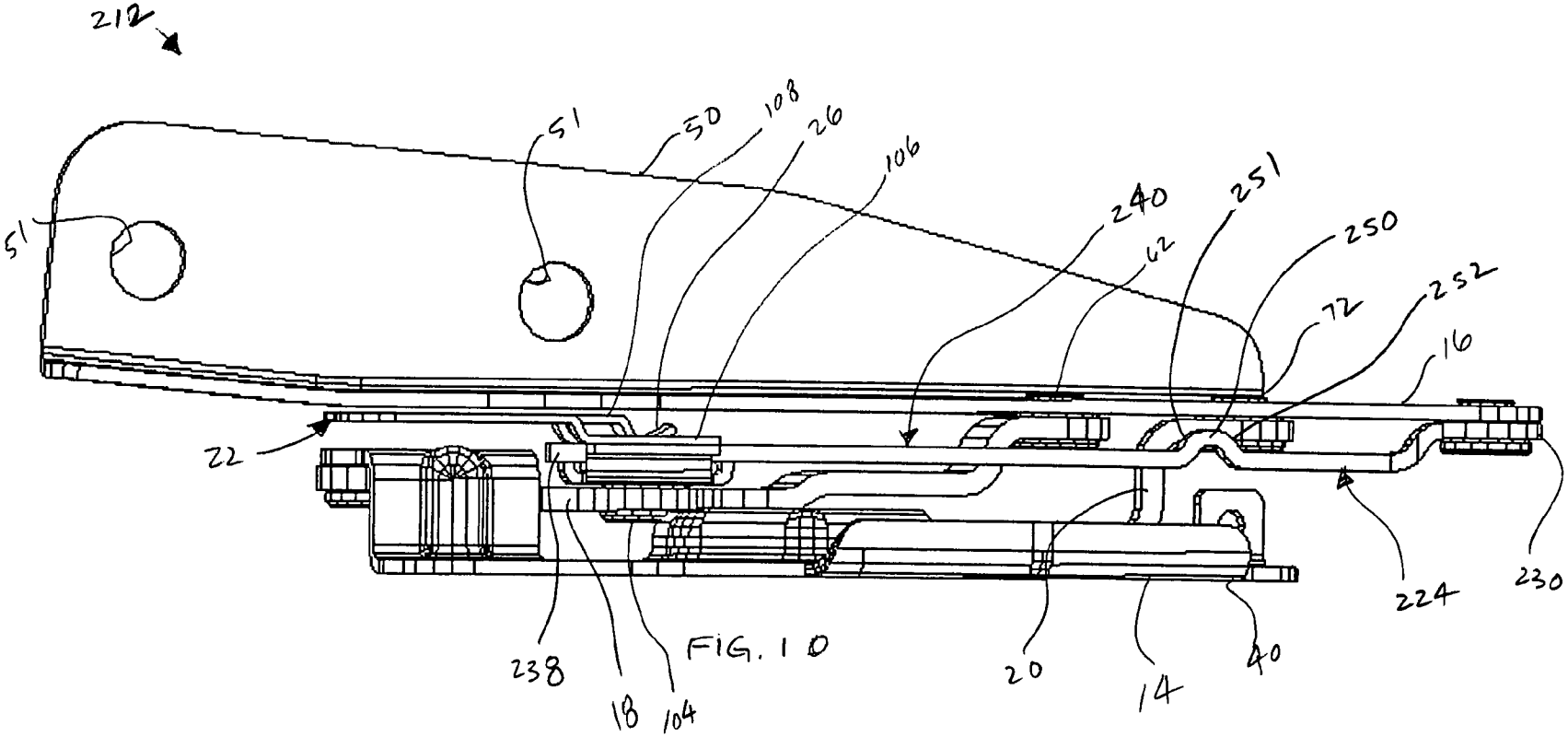
FIG. 10 illustrates a bottom view of a hinge that is similar to FIG. 4, but showing the hinge with another embodiment of a check link, in accordance with the subject invention.
Figure 11:
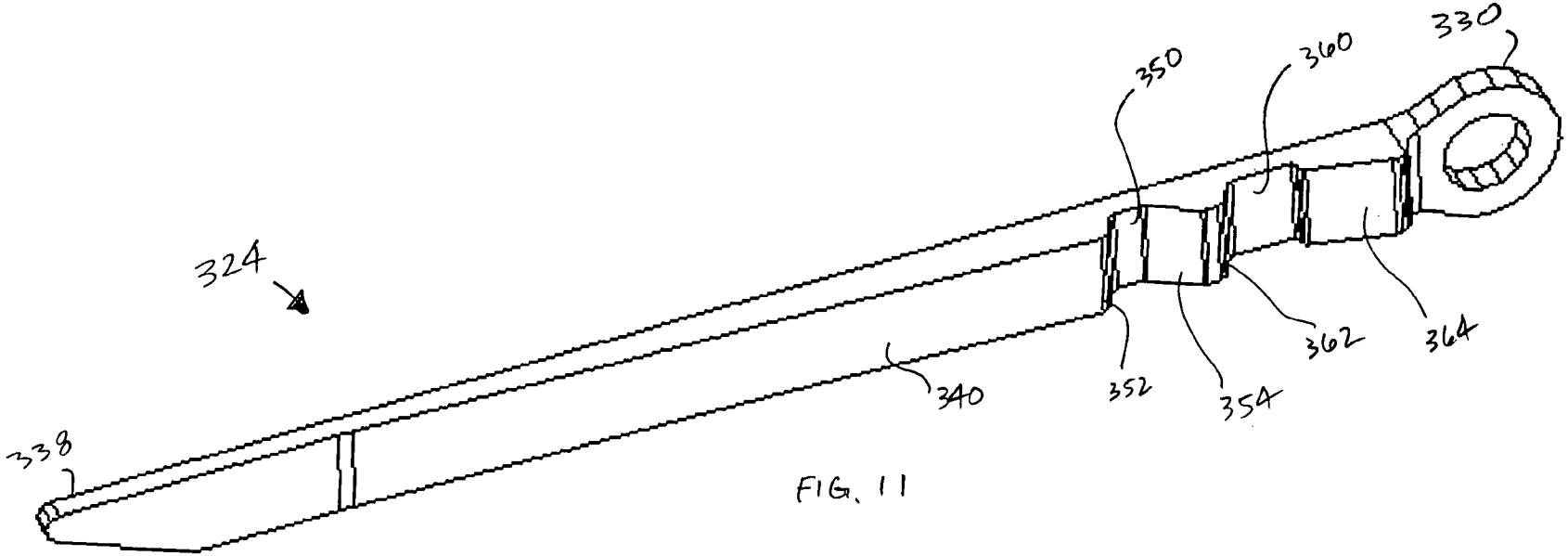
FIG. 11 illustrates a perspective view of another embodiment of a check link in accordance with the subject invention.
Figure 12:
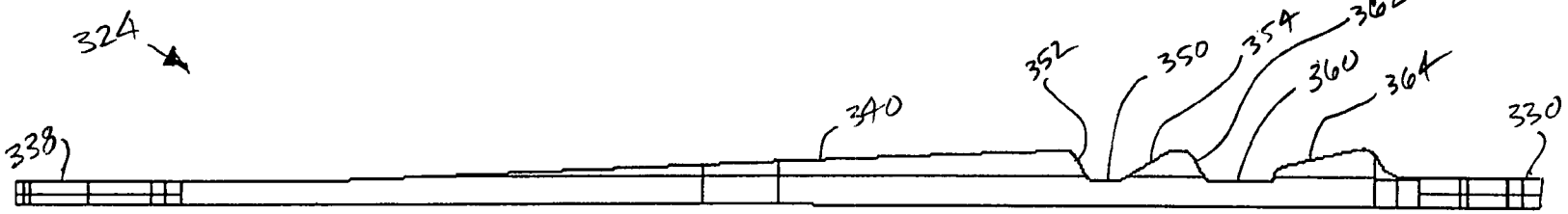
FIG. 12 illustrates a side view of the check link shown in FIG. 11.

Other embodiments of the check link are illustrated in FIGS. 10-12. FIG. 10 shows a hinge 212 and a check link 224 that are substantially identical to and function in the same way as hinge assembly 10 and check link 24, respectively, except that check link 224 has a different shape. The shape of check link 224 allows the check link to be formed from a single piece of material that may be bent, such as metal. Check link 224 may be formed with a generally flat surface 240 and a bulge 250 having a first sloped edge 251 toward the free end 238 and a second sloped edge 252 toward the pivot end 230. In the first holding position, the catch 26 is positioned adjacent the second sloped edge 252, between the bulge 250 and the pivot end 230. Thus, to move the catch 26 into the first holding position, the second part 32 must be pivot sufficiently in the open direction 148 so that the catch 26 moves along the surface 240 and over the bulge 250 in substantially the same manner as described above with respect to the movement of the catch 26 up the sloped surface 140 and into recess 28. As with the embodiment of FIGS. 1-9, the spring force of the arm 108 maintains the catch 26 in the first holding position until a sufficient closing force is applied to the hood or lid to move the catch 26 over the bulge and back toward the free end 138 of the check link and the closed position.

FIGS. 11 and 12 show a check link 324 that is substantially identical to and functions in the same way as check link 24 except that check link 324 includes multiple detents along the length of the sloped surface 240, thus permitting multiple holding positions for the linkage 80. Although any number of detents may be formed along the length of the check link, check link 324 illustrates two detents. Check link 324 illustrates a first recess 350 having a first sloped edge 352 toward the free end 338 and a second sloped edge 354 toward the pivot end 330. The first recess 350 provides for the releasable securing of the first holding portion, such as the catch 26, to maintain the respective hinge assembly in a first holding position. The check link 324 also illustrates a second recess 360 for forming a second holding position. The second recess 360 is positioned between the pivot end 330 and the first recess 350. The second recess 360 includes a first sloped edge 362 toward the free end 338 and a second sloped edge 364 toward the pivot end 330. Thus, if it is desired to further open the hood or lid 32 beyond the position dictated by the first holding position, upon the application of appropriate, additional force applied to the hood or lid 32 in the opening direction 148, the catch 26 moves up the second sloped edge 354, against the spring force applied by the arm 108, and out from the first recess 350. Then, the catch 26 will move down the first sloped edge 362 of the second recess as the catch 26 continues to move toward the pivot end 330 of the check link 324 and due to the spring force of the arm 108 forces the catch down the first sloped edge 363, into the second recess 360 and into a second holding position. The second recess 360 can be designed substantially like and provide the same results as the first recess 350 except for the holding position. Any desired number of recesses may be added to provide any number of additional detents that provide a releasable locking of the hinge assembly 10 in as many holding positions as desired. As mentioned above, additional holding positions may be desired for various reasons and may provide for more and/or, less pivoting of the second part 32 relative to the first part 30.

The position retainer assembly 100 has been illustrated in the Figures as being used in addition to the linkages 14, 16, 18, 20 permitting the pivoting of the second member 16 relative to the first member 14, but the position retainer assembly 100 may be adapted so that the position retainer assembly 100 is part of the mechanism providing the hinged movement between the first and second members 14 and 16.

Although the embodiments illustrated in the Figures show an arrangement for a hood or lid opening upwardly and closing downwardly, i.e., vertical opening and closing, the principles of the position retainers, such as in position retainer assembly 100, may be applied to other orientations, such as with side doors or other devices, which open and close laterally, i.e., horizontal opening and closing.

The foregoing embodiments have been provided to illustrate the structural and functional principles of the present invention, and are not intended to be limiting. To the contrary, the present invention is intended to encompass all modifications, alterations, and substitutions within the scope of the appended claims.

What is claimed is:

1. A hinge for use in a motor vehicle, comprising:

a first member;

a second member pivotably coupled to said first member so that said second member pivots vertically with respect to said first member such that said second member pivots upwardly in an opening direction, which is away from said first member and towards an open position, and downwardly in a closing direction, which is away from said open position and towards said first member; and first and second position retainers coupled between said first member and said second member to releasably secure said second member in a first holding position relative to said first member, said first position retainer having a first holding portion and said second position retainer having a second holding portion, one of said first and second position retainers being structured and arranged to move relative to the other of said first and second position retainers such that said first and second holding portions releasably engage one another in said first holding position of said second member, said first and second holding portions being structured and arranged to be releasably secured to each other in said first holding position;

third and fourth members coupled between said first and second members to form a linkage with said first and second members;

said first position retainer is pivotably coupled to one of said first, second, third or fourth members and said second position retainer is pivotably coupled to another of said first, second, third or fourth members.

2. A hinge according to claim 1, wherein said first member is a first link structured and arranged to be coupled to a first part of said motor vehicle, and said second member is a second link structured and arranged to be coupled to a second part of said motor vehicle.

3. A hinge according to claim 1, wherein one of said first and second holding portions includes a protruding part and the other of said first and second holding portions includes a corresponding receiving part for receiving said protruding part.

4. A hinge according to claim 3, wherein said first and second holding portions form first and second spaced apart detents.

5. A hinge for use in a motor vehicle, comprising:

a first member;

a second member pivotably coupled to said first member so that said second member pivots vertically with respect to said first member such that said second member pivots upwardly in an opening direction, which is away from said first member and towards an open position, and downwardly in a closing direction, which is away from said open position and towards said first member; and first and second position retainers coupled between said first member and said second member to releasably secure said second member in a first holding position relative to said first member, said first position retainer having a first holding portion and said second position retainer having a second holding portion, one of said first and second position retainers being structured and arranged to move relative to the other of said first and second position retainers such that said first and second holding portions releasably engage one another in said first holding position of said second member, said first and second holding portions being structured and arranged to be releasably secured to each other in said first holding position;

third and fourth members coupled between said first and second members to form a linkage with said first and second members;

said first position retainer is pivotably coupled to said third member and said second position retainer is pivotably coupled to said second member.

6. A hinge for use in a motor vehicle, comprising:

a first member;

a second member pivotably coupled to said first member so that said second member pivots vertically with respect to said first member such that said second member pivots upwardly in an opening direction, which is away from said first member and towards an open position, and downwardly in a closing direction, which is away from said open position and towards said first member; and first and second position retainers coupled between said first member and said second member to releasably secure said second member in a first holding position relative to said first member, said first position retainer having a first holding portion and said second position retainer having a second holding portion, one of said first and second position retainers being structured and arranged to move relative to the other of said first and second position retainers such that said first and second holding portions releasably engage one another in said first holding position of said second member, said first and second holding portions being structured and arranged to be releasably secured to each other in said first holding position;

one of said first and second holding portions includes a pivot part that pivots with respect to said first and second members and a resilient part that releasably engages the other of said first and second holding portions to releasably secure the first and second holding portions in said first holding position.

7. A hinge according to claim 6, further comprising:

third and fourth members coupled between said first and second members to form a linkage with said first and second members.

8. A hinge according to claim 6, wherein said resilient part is a leaf spring.

9. A hinge for use in a motor vehicle, comprising:

a first member;

a second member pivotably coupled to said first member so that said second member pivots vertically with respect to said first member such that said second member pivots upwardly in an opening direction, which is away from said first member and towards an open position, and downwardly in a closing direction, which is away from said open position and towards said first member; and first and second position retainers coupled between said first member and said second member to releasably secure said second member in a first holding position relative to said first member, said first position retainer having a first holding portion and said second position retainer having a second holding portion, one of said first and second position retainers being structured and arranged to move relative to the other of said first and second position retainers such that said first and second holding portions releasably engage one another in said first holding position of said second member, said first and second holding portions being structured and arranged to be releasably secured to each other in said first holding position;

one of said first and second holding portions includes a recess and the other of said first and second holding portions includes a spring that is resiliently and moveably secured within said recess in said first holding position.

10. A hinge according to claim 9, wherein one of said first and second position retainers is formed of plastic.

11. A hinge according to claim 10, wherein one of said first and second position retainers is integrally formed as a unitary structure.

12. A hinge assembly for a motor vehicle, comprising:

a first member coupled to a first part of said motor vehicle;

a second member coupled to an access panel of said motor vehicle and pivotably coupled to said first member so that said access panel of said motor vehicle pivots upwardly with respect to said first part of said motor vehicle into an open position; and first and second position retainers coupled between said first member and said second member to releasably secure said second part of the motor vehicle in a first holding position relative to said first part of the motor vehicle, said first position retainer having a first holding portion and said second position retainer having a second holding portion, one of said first and second position retainers being structured and arranged to move relative to the other of said first, and second position retainers such that said first and second holding portions releasably engage one another in said first holding position of said second member, said first and second holding portions being structured and arranged to be releasably secured to each other in said first holding position;

third and fourth members coupled between said first and second members to form a linkage with said first and second members;

said first position retainer is pivotably coupled to one of said first, second, third or fourth members and said second position retainer is pivotably coupled to another of said first, second, third, or fourth members.

13. A hinge assembly according to claim 12, wherein said access panel is a hood or lid.

14. A hinge assembly according to claim 12, wherein one of said first and second holding portions includes a protruding part and the other of said first and second holding portions includes a corresponding receiving part for receiving said protruding part.

15. A hinge assembly for a motor vehicle, comprising:

a first member coupled to a first part of said motor vehicle;

a second member coupled to an access panel of said motor vehicle and pivotably coupled to said first member so that said access panel of said motor vehicle pivots upwardly with respect to said first part of said motor vehicle into an open position; and first and second position retainers coupled between said first member and said second member to releasably secure said second part of the motor vehicle in a first holding position relative to said first part of the motor vehicle, said first position retainer having a first holding portion and said second position retainer having a second holding portion, one of said first and second position retainers being structured and arranged to move relative to the other of said first and second position retainers such that said first and second holding portions releasably engage one another in said first holding position of said second member, said first and second holding portions being structured and arranged to be releasably secured to each other in said first holding position;

one of said first and second holding portions including a pivot part that pivots with respect to said first and second members and a resilient part that releasably engages the other of said first and second holding parts to releasably secure the first and second holding portions in said first holding position.

16. A hinge assembly for a motor vehicle, comprising:

a first member coupled to a first part of said motor vehicle;

a second member coupled to an access panel of said motor vehicle and pivotably coupled to said first member so that said access panel of said motor vehicle pivots upwardly with respect to said first part of said motor vehicle into an open position; and first and second position retainers coupled between said first member and said second member to releasably secure said second part of the motor vehicle in a first holding position relative to said first part of the motor vehicle, said first position retainer having a first holding portion and said second position retainer having a second holding portion, one of said first and second position retainers being structured and arranged to move relative to the other of said first and second position retainers such that said first and second holding portions releasably engage one another in said first holding position of said second member, said first and second holding portions being structured and arranged to be releasably secured to each other in said first holding position;

a third member pivotably coupled to each of said first and second members, and one of said first and second position retainers is attached to said third member.

17. A hinge assembly according to claim 16, wherein said first and second position retainers are pivotably coupled to said third and second members, respectively.

18. A hinge for use in a motor vehicle, comprising:

a first member;

a second member pivotably coupled to said first member so that said second member pivots with respect to said first member; and first and second position retainers coupled between said first member and said second member to releasably secure said second member in a first holding position relative to said first member, said first position retainer having a first holding portion and said second position retainer having a second holding portion, one of said first and second position retainers being structured and arranged to move relative to the other of said first and second position retainers such that said first and second holding portions releasably engage one another in a first holding position of said second member, said first and second holding portions being structured and arranged to be releasably secured to each other in said first holding position, one of said first and second holding portions including a pivot part that pivots with respect to said first and second members and a resilient part that releasably engages the other of said first and second holding portions to releasably secure the first and second holding portions in said first holding position.

19. A hinge according to claim 18, further comprising:

third and fourth members coupled between said first and second members to form a linkage with said first and second members.

20. A hinge according to claim 19, wherein said first position retainer is pivotably coupled to said third member and said second position retainer is pivotably coupled to said second member.

21. A binge according to claim 18, wherein said resilient part is a leaf spring.

22. A hinge according to claim 18, wherein one of said first and second holding portions includes a recess and the other of said first and second holding portions includes said resilient part, said resilient part being resiliently and moveably secured within said recess in said first holding position.

23. A hinge for use in a motor vehicle, comprising:

a first member;

a second member pivotably coupled to said first member so that said second member pivots with respect to said first member;

a third member pivotably coupled to each of said first and second members; and first and second position retainers coupled between said first member and said second member to releasably secure said second member in a first holding position relative to said first member, one of said first and second position retainers being attached to said third member, said first position retainer having a first holding portion and said second position retainer having a second holding portion, one of said first and second position retainers being structured and arranged to move relative to the other of said first and second position retainers such that said first and second holding portions releasably engage one another in a first holding position of said second member, said first and second holding portions being structured and arranged to be releasably secured to each other in said first holding position;

said first position retainer is pivotably coupled to one of said first, second or third members and said second position retainer is pivotably coupled to another of said first, second or third members.

24. A hinge according to claim 23, further comprising:

a fourth member coupled between said first and second members to form a linkage with said first, second, and third members.

25. A hinge according to claim 23, wherein said first position retainer is pivotably coupled to said third member and said second position retainer is pivotably coupled to said second member.

26. A hinge for use in a motor vehicle, comprising:

a first member;

a second member pivotably coupled to said first member so that said second member pivots with respect to said first member;

a third member pivotably coupled to each of said first and second members; and first and second position retainers coupled between said first member and said second member to releasably secure said second member in a first holding position relative to said first member, one of said first and second position retainers being attached to said third member, said first position retainer having a first holding portion and said second position retainer having a second holding portion, one of said first and second position retainers being structured and arranged to move relative to the other of said first and second position retainers such that said first and second holding portions releasably engage one another in a first holding position of said second member, said first and second holding portions being structured and arranged to be releasably secured to each other in said first holding position;

one of said first and second holding portions includes a recess and the other of said first and second holding portions includes a spring that is resiliently and moveably secured within said recess in said first holding position.

* * * * *